US010527267B2

(12) United States Patent
Chavan et al.

(10) Patent No.: US 10,527,267 B2
(45) Date of Patent: Jan. 7, 2020

(54) RESTRICTED SWIVEL KNUCKLE DESIGN TO AVOID TWISTING OF WIRES

(71) Applicant: Sigma Electric Manufacturing Corporation, Garner, NC (US)

(72) Inventors: Vinayak Manohar Chavan, Maharashtra (IN); Anand Chandrakant Dhotre, Maharashtra (IN)

(73) Assignee: Sigma Electric Manufacturing Corporation, Garner, NC (US)

( * ) Notice: Subject to any disclaimer, the term of this patent is extended or adjusted under 35 U.S.C. 154(b) by 0 days.

(21) Appl. No.: 16/124,375

(22) Filed: Sep. 7, 2018

(65) Prior Publication Data

US 2019/0271454 A1 Sep. 5, 2019

Related U.S. Application Data

(60) Provisional application No. 62/556,069, filed on Sep. 8, 2017.

(51) Int. Cl.

| | |
|---|---|
| ***F21V 21/14*** | (2006.01) |
| ***F21V 17/10*** | (2006.01) |
| ***F21V 15/01*** | (2006.01) |
| ***F21V 19/04*** | (2006.01) |

(52) U.S. Cl.
CPC ..... *F21V 21/14* (2013.01); *F21V 15/01* (2013.01); *F21V 17/10* (2013.01); *F21V 19/04* (2013.01)

(58) Field of Classification Search
CPC ..... F21V 21/14; F21V 17/10; F21V 15/01; F21V 19/04
See application file for complete search history.

(56) References Cited

U.S. PATENT DOCUMENTS

| | | | |
|---|---|---|---|
| 6,030,095 | A | 2/2000 | Moore et al. |
| 7,390,110 | B2 | 6/2008 | Katz et al. |
| 7,494,252 | B1 | 2/2009 | Thornton et al. |
| 8,888,327 | B1 | 11/2014 | Baldwin et al. |
| 9,080,749 | B2 | 7/2015 | Salomon |

*Primary Examiner* — Joseph L Williams
(74) *Attorney, Agent, or Firm* — Cantor Colburn LLP

(57) ABSTRACT

A light fixture comprising, a housing having a base, a support arm, an opening opposite the base with a lens disposed in the opening, and a light source disposed within the housing; and an anchor portion having a fastening end and a cylindrical projection with a tooth on a surface of the cylindrical projection, and a central axis extending through the anchor portion into the support arm; and a spherical joint comprising an inner channel extending less than 360 degrees around the inner surface of the spherical joint; and a sealing grommet. The light fixture is configured to enable relative longitudinal motion between the spherical joint and the support arm and configured to prevent rotational motion therebetween.

19 Claims, 9 Drawing Sheets

RESTRICTED SWIVEL KNUCKLE DESIGN TO AVOID TWISTING OF WIRES

CROSS REFERENCE TO RELATED APPLICATIONS

This application is a non-provisional of and claims priority to U.S. Application Ser. No. 62/556,069, filed Sep. 8, 2017, which is incorporated herein by reference in its entirety.

BACKGROUND

Outdoor light systems have been commonly used as security lights in a variety of ways to increase the safety of a home, office, outdoor space, or commercial building. For example, outdoor lights can include a motion sensor that can detect motion within a specified distance from the light. In the past, conventional outdoor lighting systems were designed and constructed to provide a desired light distribution for a particular application.

Outdoor lighting systems use light fixtures that aim a lamp in a desired direction to illuminate a particular area. The light fixture typically included adjustable connections that allowed the user to aim the light when the light fixture is installed. The ability to adjust the light, e.g., the direction of the beam, is generally required by the consumer. However, adjustment of the light can cause failure of the wiring.

There continues to be a need for light systems that are adjustable yet avoid wiring problems.

SUMMARY

Disclosed, in various embodiments, are light fixtures. A light fixture comprises a housing having a base, a support arm, and an opening opposite the base with a lens disposed in the opening, and a light source disposed within the housing, and an anchor portion having a fastening end and a cylindrical projection with a tooth on a surface of the cylindrical projection, and a central axis extending through the anchor portion into the support arm, a spherical joint comprising an inner channel extending less than 380 degrees around the inner surface of the spherical joint; and a sealing grommet located within the support arm; wherein the light fixture is configured to enable relative longitudinal motion between the spherical joint and the support arm and configured to prevent rotational motion therebetween.

These and other features and characteristics are more particularly described below.

BRIEF DESCRIPTION OF THE FIGURES

Refer now to the figures, which are illustrative and not limiting, and where like elements are numbered alike.

DETAILED DESCRIPTION

Figure 1:
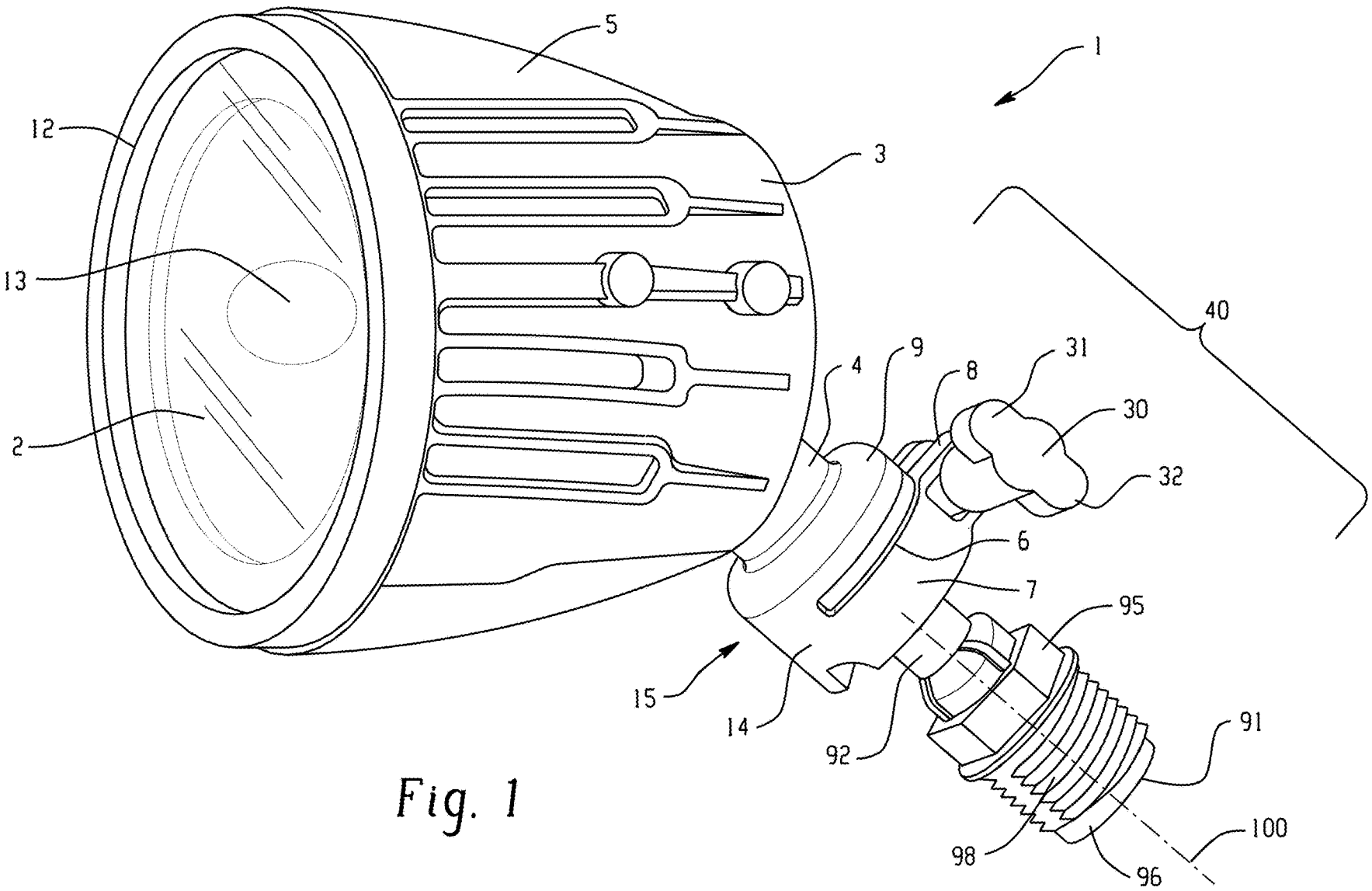
FIG. 1 is a perspective view of an embodiment of an assembled light fixture.

Lighting systems, when installed comprise a light fixture that houses a light source. The light source is electrically connected to a power source via wires that extend into the light fixture. Adjustable light fixtures, e.g., that allow unrestricted rotational adjustment of a light housing, can allow twisting of wires which can lead to disengagement, tangling, or fraying of the wires. Disclosed herein is a light system that allows rotational and longitudinal adjustment of the light fixture, while inhibiting twisting, disengagement, and fraying of the wires.

The lighting system comprises a light fixture with a housing, a light source, and a support arm. Extending into the support arm is a grommet, with a spherical joint located between the inner surface of the grommet and an anchor portion. The anchor portion can be used to affix the light fixture to a structure. Wiring can extend through the anchor portion, through the spherical joint, grommet, and support arm to the light source. The spherical joint, in conjunction with the anchor portion, enables rotational movement of the support arm, and hence the housing, by less than 360°, for example, from 0 to 358°, or from 0 to 355°, or from 0 to 340°, around an axis "A" that extends through the spherical joint from the anchor portion to the support arm. The spherical joint, in conjunction with the grommet, enables the housing to pivot relative to the axis A, thereby enabling the housing to move up and down.

The grommet can have an inner diameter for receiving the spherical joint and an outer diameter to securely seat within the support arm. The grommet can comprise a ductile material that forms a barrier to inhibit foreign matter (e.g., water, dust, insects, and the like) from entering the housing or the channel comprising the wires. For example, the grommet can comprise rubber.

The lighting system can comprise multiple light fixtures so as to enable lighting of a broader area. For example, the lighting system can comprise two lights.

Optionally, the lighting system can comprise a sensor, for example, can comprise at least one of a motion sensor and a photo sensor. For example, the lighting system can comprise at least two lights connected to a single motion sensor. Optionally, the lighting system can comprise at least two lights each connected to different motion sensors. The motion sensor can comprise at least one of an ultrasonic sensor element (transducer) and a passive infrared (PIR) sensor element. It may also comprise a control circuit, a microprocessor, and a user interface. The sensor can be used to turn the lights on or off. For example, when the motion sensor detects an intrusion, the light is switched from off (or from a low level illumination) to a high level illumination, e.g., for a short duration time to illuminate the area for better visibility and/or to scare away the intruder. After the desired duration of time, the light can be returned to its original state (e.g off or to the low level illumination). The photo sensor can be designed to, when in the dusk to dawn mode, automatically enable the operation of the lighting device at nightfall and disabling the device operation at daybreak. The sensors can be used along or together. For example, the photo sensor can enable the operation of the light system when ambient light falls below a threshold. The photo sensor can enable a low level of light and/or can enable only a portion of the light sources in the lighting system. The motion sensor, when an intrusion is detected, can change the intensity of the light and/or can enable another portion of the light sources. The additionally enabled light sources and/or the higher intensity can be disabled after at least one of a period of time and failure to detect an intrusion for a period of time.

Referring now to the figures, which are exemplary and not intended to limit the scope hereof A more complete understanding of the components, processes, and apparatuses disclosed herein can be obtained by reference to the accompanying drawings. These figures (also referred to herein as "FIG.") are merely schematic representations based on convenience and the ease of demonstrating the present disclosure, and are, therefore, not intended to indicate relative size and dimensions of the devices or components thereof and/or to define or limit the scope of the exemplary embodiments. Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

Figure 2:
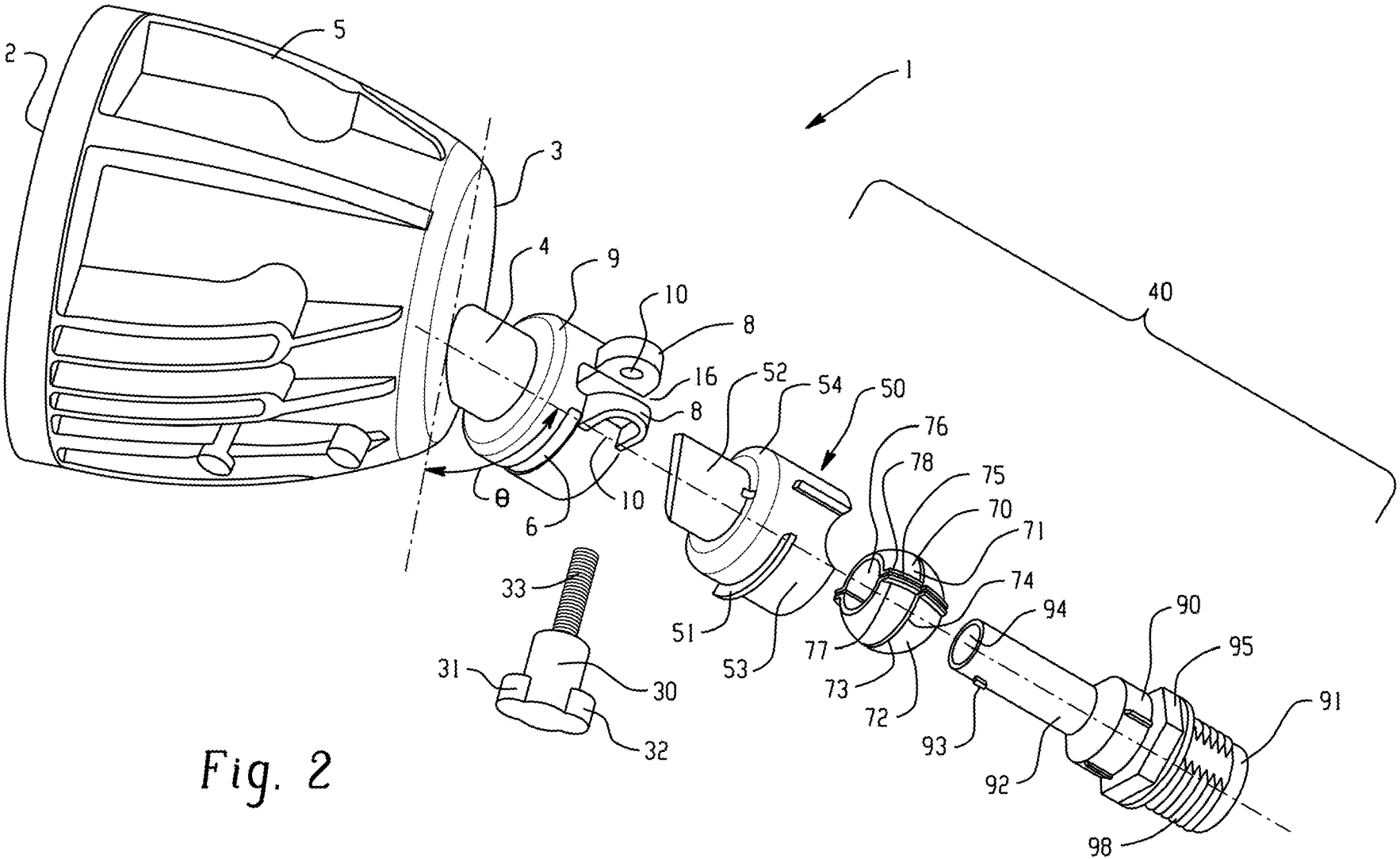
FIG. 2 is a perspective view of the disassembled light fixture of FIG. 1.

FIG. 1 depicts an assembled light fixture 1, while FIG. 2 illustrates a disassembled, expanded view of the light fixture of FIG. 1. The light fixture 1 can allow a lighting element 13 to move vertically (e.g., pivot) relative to the central axis 100 (also referred to herein as axis A) and rotationally around the central axis 100, while preventing a cord (not shown) that extends through the light fixture and connects to the base 3, from tangling. The light fixture 1 can comprise a light housing 5 for receiving a light source 13 and a support assembly 40. The housing 5 can include an opening 12 opposite a base 3. The opening 12 can include a lens 2 disposed within the opening to prevent ingress of water and foreign objects, (such as insects, dust and dirt, pollen, and the like) from reaching the light source 13. The lens 2 can be, for example, colored, transparent, or tinted. Optionally, the base 3 can be attached to a power source (not shown), such that the power source can supply power to the light source 13. The light source 13 is not particularly limited, for example, the light source 13 can be an incandescent, light emitting diode (LED) a halogen, fluorescent, mercury-vapor.

A support arm 15 can extend from the base. The support arm 15 can be non-moveably attached to the base 3. For example the support arm 15 and the base 3 can be made from a single mold, or the support arm 15 and the base 3 can be made from two separate molds and non-moveably joined together (e.g., welded). The support arm 15 can be hollow, i.e., can comprise a central bore, such that a wire can be extended through the support arm 15 and into the housing 5 where it is electrically connected to the light source 13. The support arm 15 can comprise a body 14 with a neck 4 extending from the body and connected to the base 3. The neck 4 can connect to the base at an angle θ, as measured along the central axis 100, of 90°, or at an angle of less than 90°, with respect to the surface of the base 3. (See FIG. 2)

Although the body 14 and the neck 4 can have the same diameters, desirably, the neck 4 has a smaller diameter than the body 14. In other words, the body 14 can have a shoulder 9 that decreases the diameter of the body 14 to the diameter of the neck 4. The shoulder 9 can act as a stop for the grommet 50 which comprises a grommet shoulder 54. An inner diameter of the neck 4 should be wide enough to pass a power source therethrough.

In order to inhibit disassembly of the grommet from the support arm, the body 14 of the support arm and the grommet 50 can have an interference fit, a snap fit, a twist lock, or the like. A snap fit can engage the body 14 and the grommet 50. For example, the body 14 can comprise a slot 6 sized and shaped to engage with the jut 51 of the grommet 50. When the sealing grommet 50 is engaged in the support arm 14, movement of the sealing grommet 50 along the central axis should be prevented. (see also FIGS. 5A and 5B). The engagement between the grommet 50 and support arm 15 can also prevent this movement. The jut 51 can be, for example, a radial projection that fits within a slot 6. The engagement of the slot 6 and the jut 51 can removably couple the sealing grommet 50 to the light housing 5, while preventing rotational movement of the sealing grommet 50 with respect to the support arm 15. The secure and preferably tight engagement of the grommet 50 and the support arm 15 further enables weatherability of the light fixture 1.

Secure connection between the support arm 15 and the support assembly 40 can be further enhanced. The support arm 15 can include tabs 8 on the sides of an adjustable opening 16 at the distal end of the support arm 15. The tabs 8 can be moved closer together or further apart within the adjustable opening 16 to decrease or increase the diameter of the body 14, respectively. Movement of the tabs 8 can be accomplished via a fastener 30. The fastener 30 can comprise any connector that can prevent the increase in the size of the opening 16 from its size at a resting state. For example, a connector that can reduce the size of the opening 16 by decreasing the distance between the tabs 8. For example, the fastener can comprise a bolt and nut, a rod and hitch pin, and so forth. For example, the fastener 30 can comprise a grip (e.g., handle projections 31, 32) with a threaded portion 33 extending from the grip. Openings 10 in each tab 8 can have a thread on the interior surface configured to engage threads of the threaded portion such that, once the lip 11 contacts a tab 8, continued turning of the fastener 30 in one direction can hold the tabs in place or can draw the tabs 8 closer together, while turning the grip of the fastener 30 in the other direction can unscrew the fastener 30 from the body 15. (See also FIGS. 7A and 7B). Alternatively, or in addition to the threads in the tabs, the fastener 30 can optionally include a nut on the end opposite the grip, to allow for tightening of the tabs 8.

The support assembly 40 can comprise an anchor portion 90. The anchor portion 90 can comprise a cylindrical projection 92, and a grip area 95 located between the projection 92 and a fastening end 91. The fastening end 91 can comprise threads 98, e.g., for attaching the light system to a mounting area such as a mounting bracket, a wall, beam, and/or ceiling. The anchor portion 90 can be hollow such that a cord (e.g., wires connected to a power source) can be passed therethrough.

As shown in FIG. 2, the support assembly 40 can comprise a sealing grommet 50, a spherical joint 70 and the anchor portion 90. The sealing grommet 50 can be of any shape such that the sealing grommet can fit within the support arm 4. For example, the sealing grommet 50 can be cylindrical. The sealing grommet can comprise a projection 52 that fits within the neck 4, such that the exterior surface of the projection 52 is the same shape and size as the interior edge of the neck 4. The sealing grommet 50 can further include a distal end 53 that can seat the spherical joint 70. The distal end 53 of the sealing grommet can be circular, such that the interior diameter of the distal end 53 is the same as the exterior diameter of the spherical joint 70. The sealing grommet 50, spherical joint 70 and anchor portion 90 can be coupled together such that the spherical joint 70 can be inserted into the distal end of the sealing grommet 50.

Figure 3A:
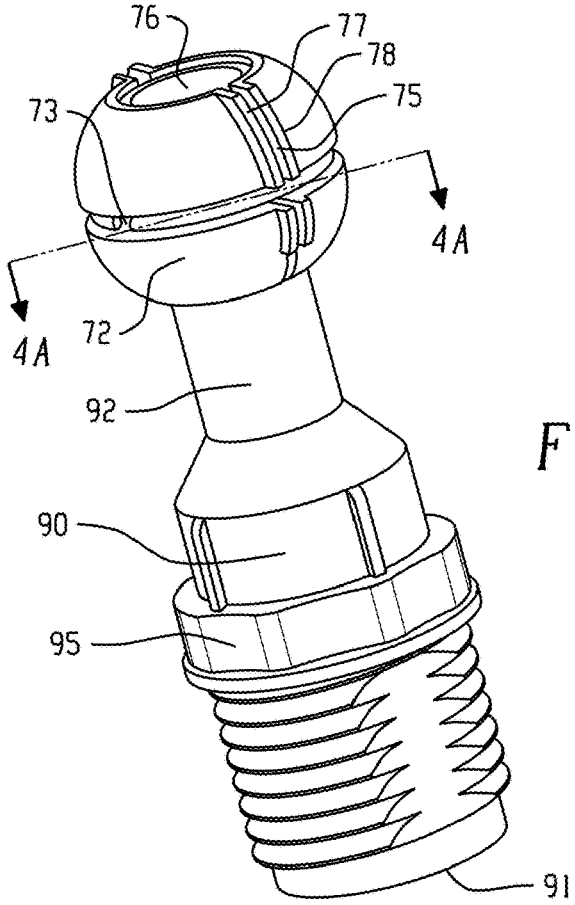
FIG. 3A is a perspective view of a spherical joint assembled onto an anchor portion.
Figure 3B:
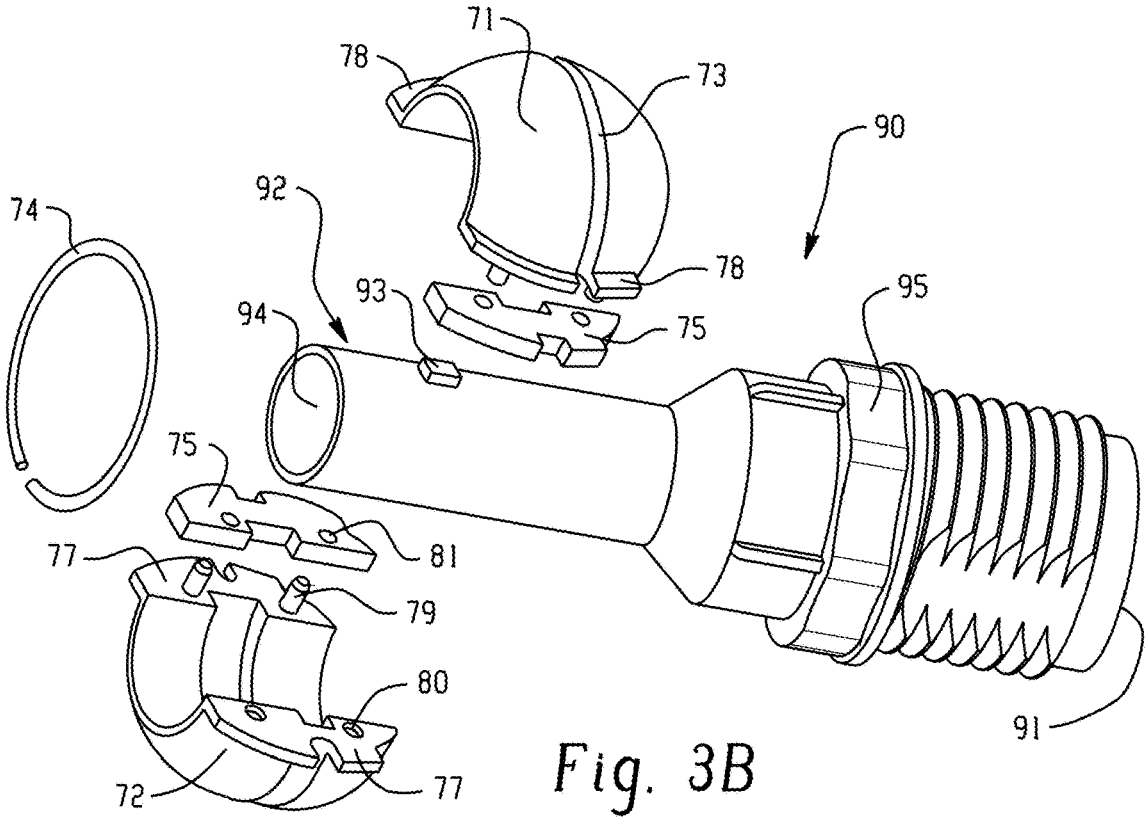
FIG. 3B depicts the spherical joint and anchor portion of FIG. 3A disassembled.

FIG. 3A depicts the spherical joint 70 assembled on the anchor portion 90. FIG. 3B depicts a disassembled view of an example of a way the spherical joint 70 can be assembled onto the anchor portion 90. The spherical joint 70 can comprise a first hemisphere 71 and a second hemisphere 72. The first hemisphere 71 and second hemisphere 72 can be oriented coaxially. The first hemisphere 71 and second hemisphere 72 can be permanently attached to form the spherical joint 70. For example, the first hemisphere 71 and second hemisphere 72 each comprise an axial groove 73 along a common latitude. The axial groove 73 can accept a spring clip 74, such that the spring clip 74 can removably attach the first hemisphere 71 to the second hemisphere 72.

Alternatively, or in addition, each of the first hemisphere 71 and second hemisphere 72, can comprise a longitudinal projection 77, 78. The longitudinal projection 77, 78 can be present on one or both edges of the first hemisphere 71 and second hemisphere 72. Optionally, one or more gaskets 75 can be included between the first hemisphere 71 and second hemisphere 72. The gasket 75 can create a waterproof barrier between the first hemisphere 71 and second hemisphere 72. The gasket 75 can be made of rubber, or any other compressible, waterproof material. The first hemisphere 71 and second hemisphere 72 can each comprise an interior channel with the same radius, such that when the first hemisphere 71 and second hemisphere 72 are attached to create a spherical joint 70, the spherical joint 70 comprises a cylindrical bore 76 through the center of the spherical joint 70.

The anchor portion 90 can comprise a cylindrical projection 92, a grip area 95, and a fastening end comprising a means for fastening to a support, such as threading. The anchor portion 90 can comprise a central bore 94 along the longitudinal axis, such that a wire is able to be passed through the central bore 94. The anchor portion 90 can further comprise a tooth 93 that projects radially outward from the cylindrical projection 92.

The cylindrical projection 92 can extend into, and preferably through, the central bore 76 of the spherical joint 70 (e.g., such that the proximal end of the spherical joint 70 is near to cylindrical projection 92). As described above, the spring clip 74 can attach the first hemisphere 71 to the second hemisphere 72 around the cylindrical projection 92, as shown in FIG. 3B. The first hemisphere 71 can engage with the second hemisphere 72 before attachment of the spring clip 74. For example, one or both of the first hemisphere 71 and the second hemisphere 72 can comprise projections 79 that align with holes 80 in the other hemisphere, such that the projection 79 can fit within the holes 80 to removably attach the first hemisphere 71 to the second hemisphere 72. If a gasket 75 is engaged between the first hemisphere 71 and the second hemisphere 72, the gasket can create a seal between the first hemisphere 71 and the second hemisphere 72. The gasket 75 can include a hole 81 that aligns with the projection 79 such that the projection 79 can pass through the hole 81 and into holes 80 to removably couple the first hemisphere 71 to the second hemisphere 72 with the gasket 75 therebetween.

Figure 4B:
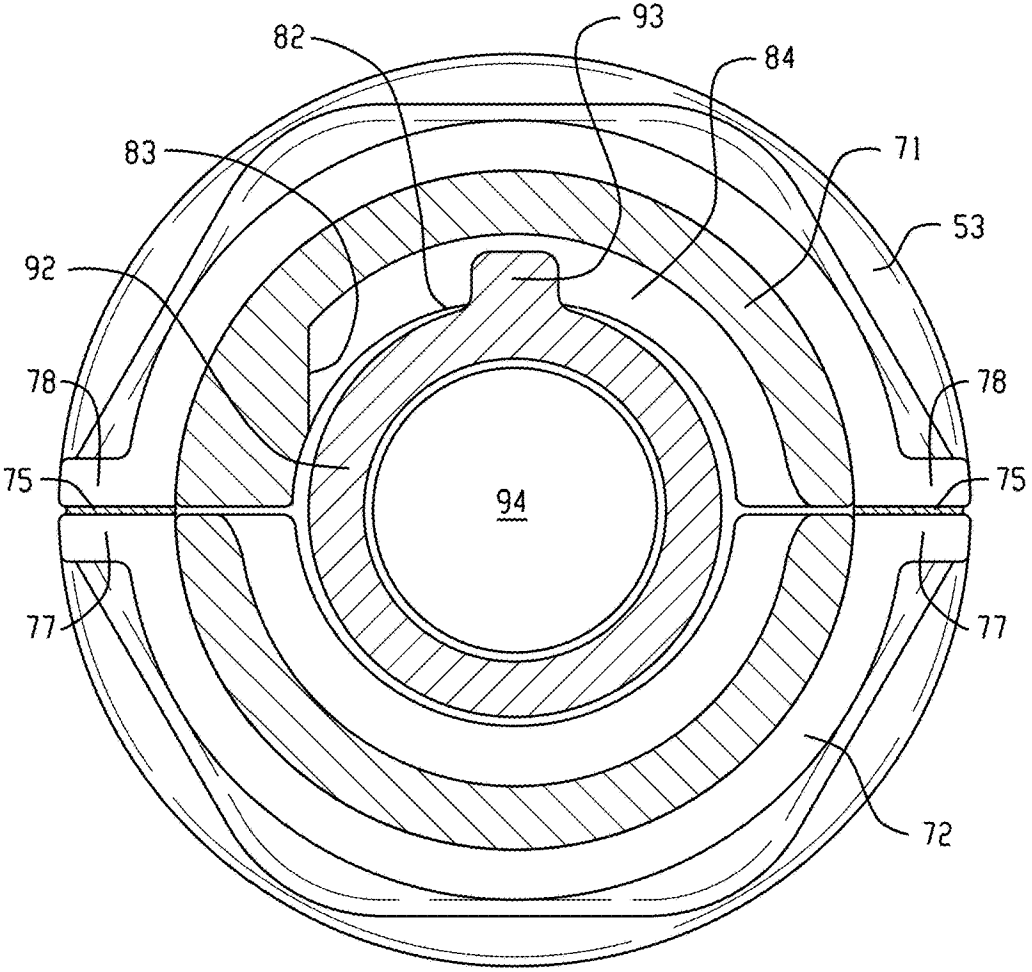
FIG. 4B is an exploded cross-sectional view of the spherical joint and anchor portion of FIG. 4A.
Figure 4A:
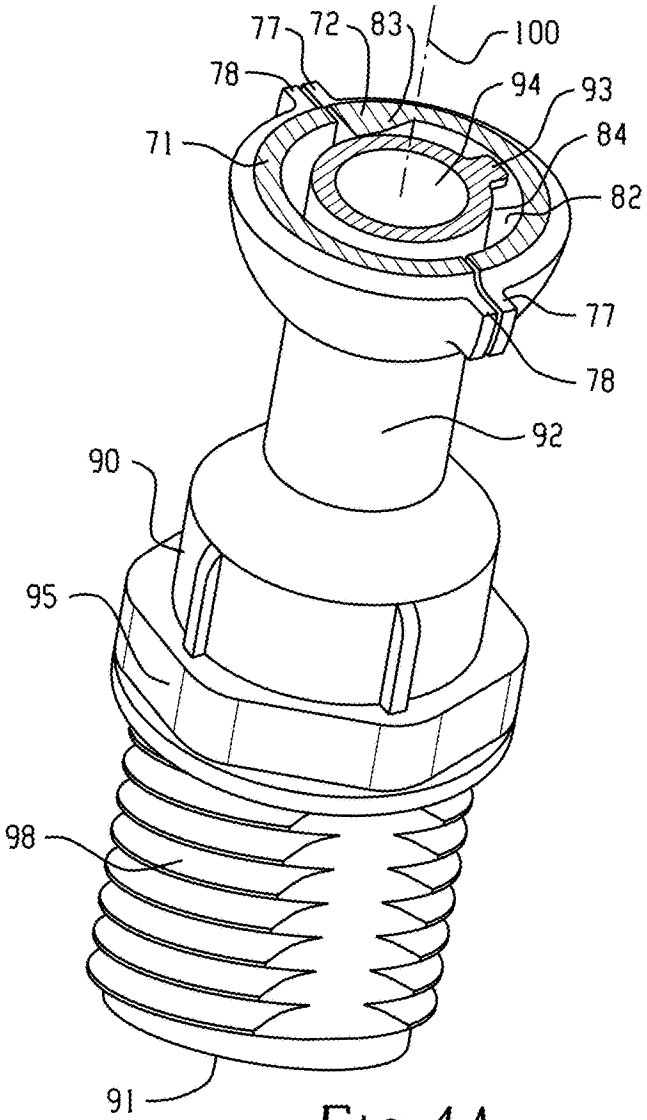
FIG. 4A is a cross sectional view of the spherical joint and anchor portion taken along lines 4A-4A of FIG. 3A.

FIG. 4A depicts a cross sectional view of the assembly of FIG. 3A. As shown in FIGS. 4A and 4B, when the spherical joint is assembled, it is assembled around the proximal end of the anchor portion 90 such that a tooth 93 of the anchor portion 90 is located in a channel 84 of the spherical joint 70. The tooth 93 can be free to rotate within inner channel 84, allowing the spherical joint 70 (and hence the support arm 15 and therefore the housing 5) to rotate about the central axis 100 relative to the anchor portion 90. The inner channel 84 can extend around the inner surface 82 of the spherical joint 70 to the extent that the spherical joint 70 is desired to be free to rotate about the central axis 100 relative to the anchor portion 90. For example, the inner channel 84 can extend less than 370 degrees, preferably less than 360 degrees, around the inner surface 82 of the spherical joint 70 so that the spherical joint 70 can be free to rotate less than 380 (preferably less than 370, and more preferably less than 360) degrees about the central axis 100 relative to the anchor portion 90.

A stopper 83 can be provided on the interior surface 82 of the spherical joint 70, e.g., so that the channel 84 extends less than 380 (preferably less than 370, and more preferably less than 360) degrees. The stopper 83 can be an inward projection to the interior surface 82, thereby blocking the channel 84 such that the stopper 83 prevents motion of the tooth 93 past the stopper 83. The stopper 83 can be configured to prevent the housing 5 from rotating beyond 380 (preferably 370, and more preferably 360) degrees. The position of the stopper 83 and the position of the tooth 93 can be varied so that rotation is prevented after a specified degree of rotation. For example, the channel 84 and stopper 83 configuration can allow rotation of the housing by less than 380 (preferably less than 370, and more preferably less than 360) degrees, e.g., by less than or equal to 350 degrees around axis 100. As shown in FIG. 4B, the spherical joint 70 can be positioned within the sealing grommet 50, such that the hemispherical projections 77, 78 prevent rotation of the spherical joint 70 within the sealing grommet 50, as further described below.

Figure 5A:
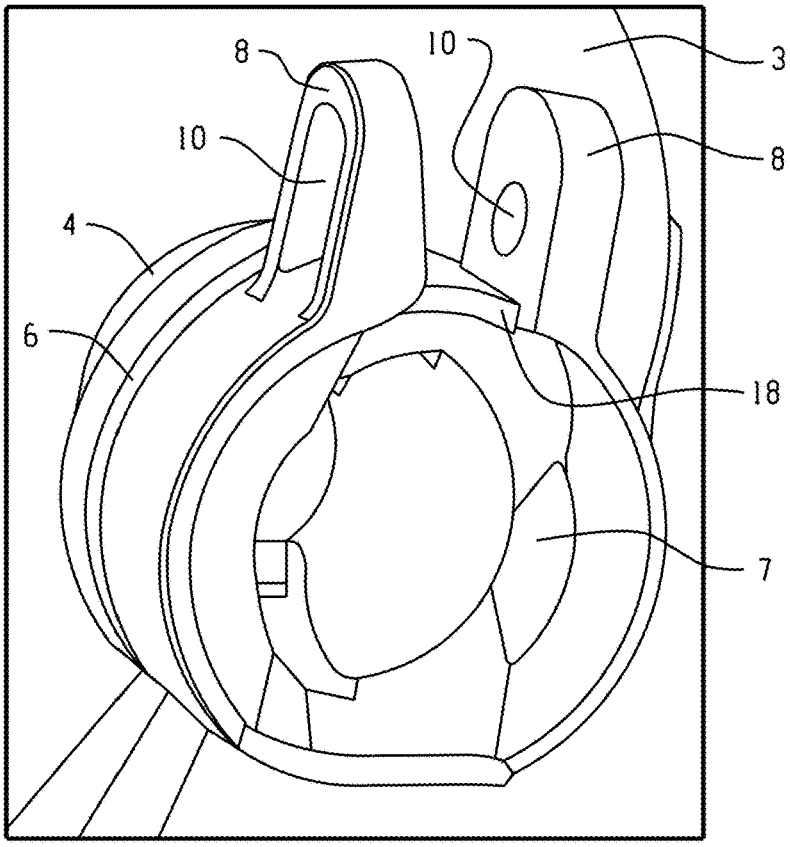
FIG. 5A is a dissected view of a sealing grommet in a support arm.
Figure 5B:
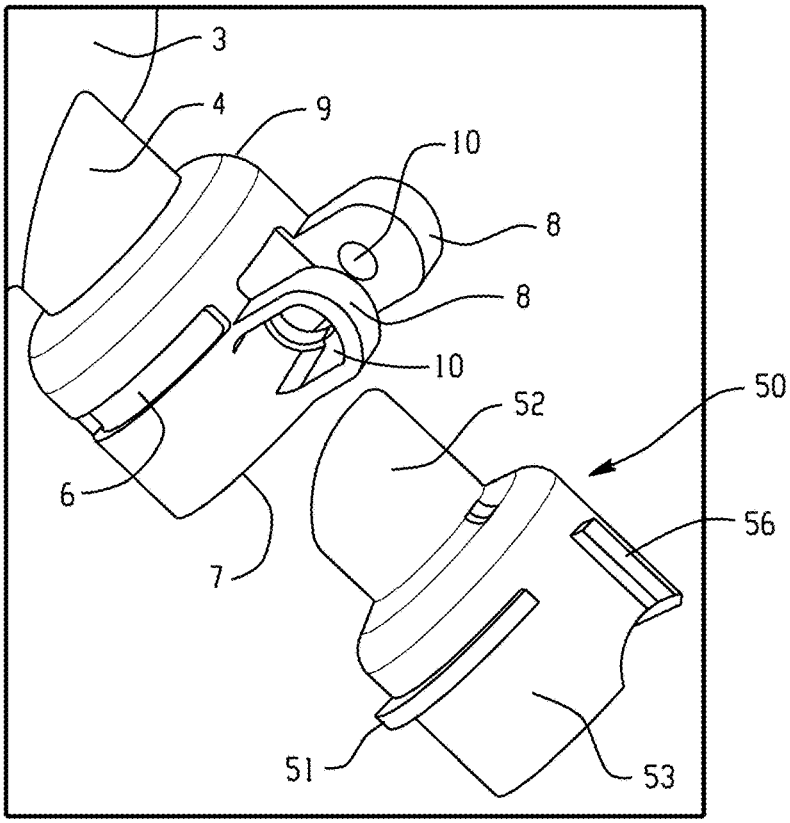
FIG. 5B depicts the sealing grommet being inserted into the support arm.
Figure 6:
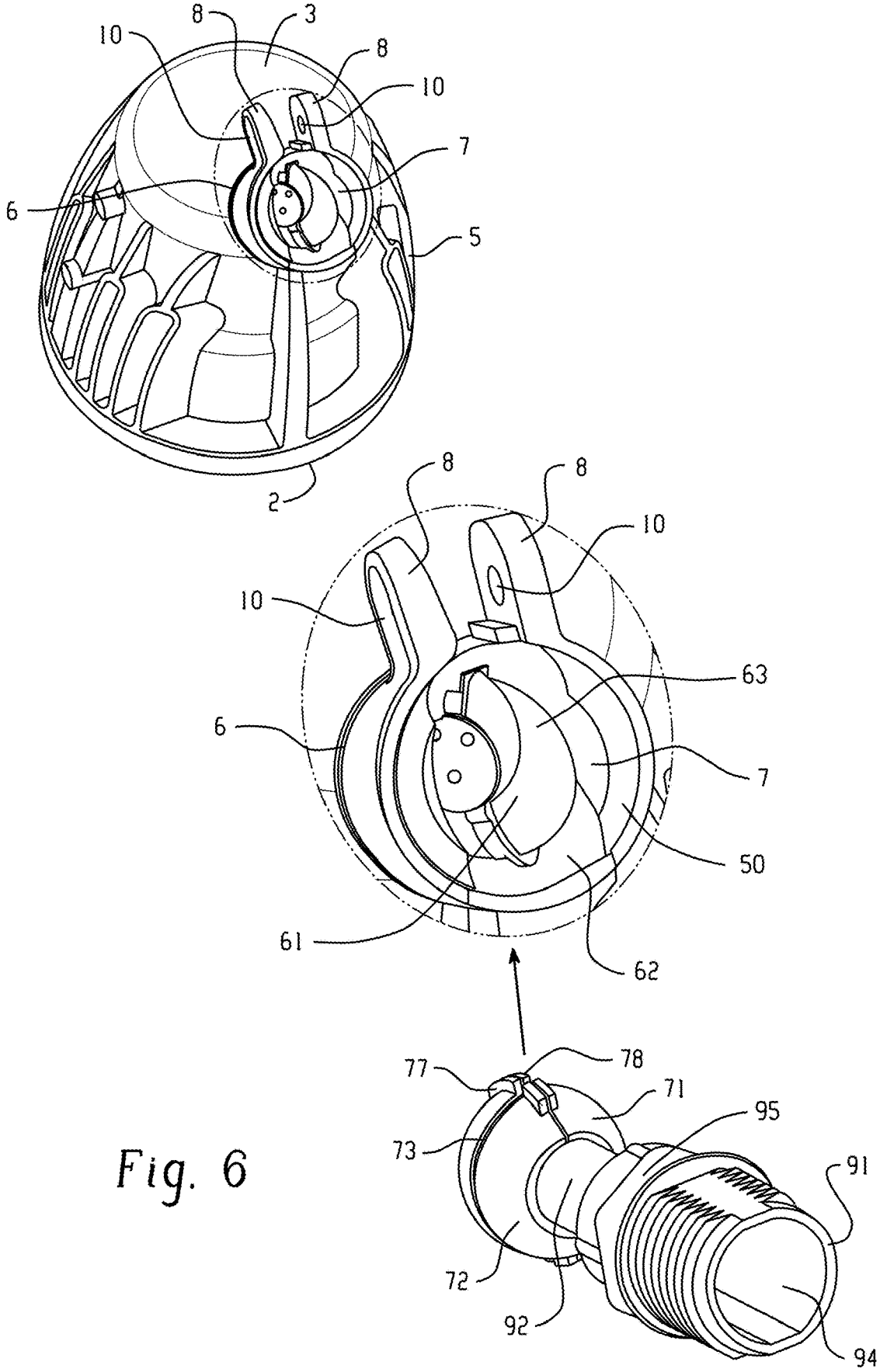
FIG. 6 depicts the engagement of a spherical joint in a sealing grommet.

FIG. 5A is an expanded view of the support arm 15 attached to the base 3. FIG. 5B shows the support arm 15 of FIG. 5A with the sealing grommet 50. The sealing grommet 50 can include a cylindrical projection 52 with an outer radius equal to the radius of the cylindrical bore 7 in the neck 4, such that the cylindrical projection 52 can be inserted into the cylindrical bore 76. The cylindrical projection 52 can have a proximal end shaped at the same angle of the neck 4 at the base 3. The distal end 53 of the spherical joint 50 can comprise a jut 51 that can fit within the slot 6 located on the support arm 15. The engagement of the jut 51 in the slot 6 can provide a tighter fit between the support arm 15 and the sealing grommet 50, such that the engagement of the sealing grommet 50 and the support arm 15 prevents water from passing therethrough. The grommet can optionally comprise an alignment ridge 55 extending out of the surface of the grommet 50. When the grommet 50 is assembled in the support arm 70, the alignment ridge 55 is located in the opening 16. The alignment ridge 55 maintains the orientation of the grommet 50 when the housing 5 is rotated by moving the tooth 93 within the channel 84. Optionally, the body 14 can comprise a groove 18 configured to receive the alignment ridge 55. FIG. 6 illustrates the engagement of the assembled spherical joint 70 and anchor portion 90 of FIG. 3A into the sealing grommet 50 and the support arm 15. The sealing grommet 50 can be engaged within the cylindrical bore 7 in the neck 4 of the support arm 15 as described above and depicted in FIG. 5B. The sealing grommet 50 can include a central opening 61 configured to accept the spherical joint 70, such that the radius of the central opening 61 is greater than or equal to the external radius of the spherical joint 70. The sealing grommet 50 can further include two radial openings 62, 63 in the central opening 61, configured to accept the longitudinal projections 77, 78, such that the spherical joint 70 is prevented from moving within the sealing grommet 50 along more than one axis. The engagement of the longitudinal projections 77, 78 in the radial openings 62, 63 of the sealing grommet 50 can allow pivotal movement of the spherical joint 70 (and hence the housing 5) with relation to the central axis 100 and enabling engagement with the support arm 15 such that rotation around the central axis 100 (as the tooth 93 moves in channel 84) results in movement of the housing 5, support arm 15, grommet 50, and spherical joint 70 as a single unit. Movement of the spherical joint 70 along the central axis 100 allows the light housing 5 to move closer to and further from the anchor portion 90. Desirably the cylindrical projection 92 has a sufficient length such that pivoting of the support arm 15 and housing 5 are not inhibited by contact with the grip area 95.

Figure 7A:
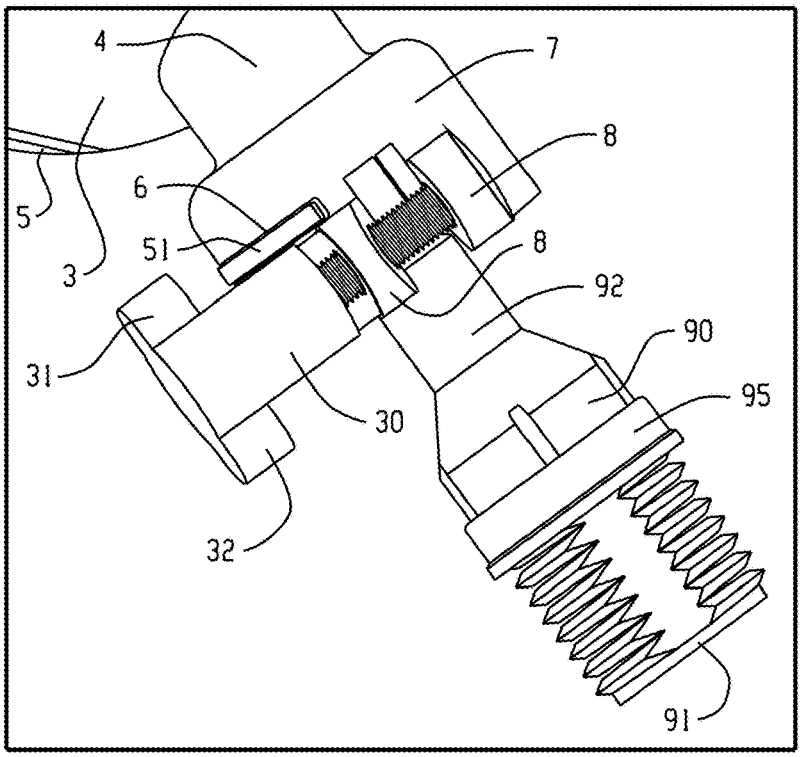
FIG. 7A is an exploded view of the distal end of the assembled light fixture.
Figure 7B:
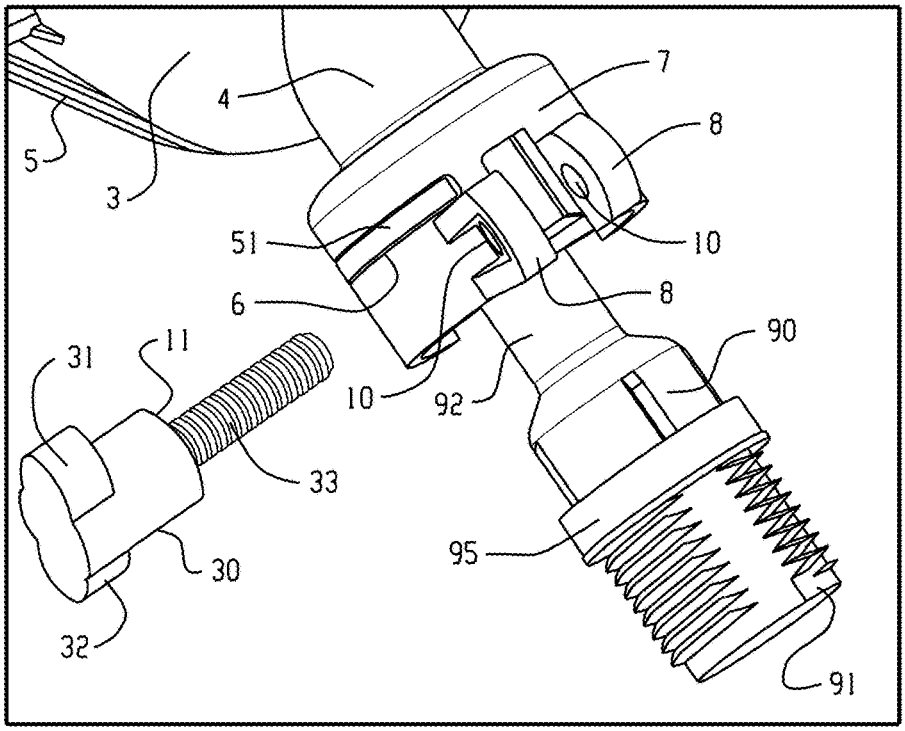
FIG. 7B depicts the fastening of a support assembly to the light housing.

FIG. 7A is an expanded view of a portion of the light fixture illustrating the support arm 4 tightened around the sealing grommet 50 once the assembled spherical joint 70 and anchor portion 90 are inserted into the sealing grommet 50. FIG. 7B is an expanded view of a portion of the light fixture illustrating the fastener 30 being assembled into the openings 10, which can include a threaded portion 33 for engagement with the openings 10 and 11. For example, the threaded portion 33 can comprise threading that can engage with the openings 10 upon twisting the handle projections 31, 32, to bring the tabs 8 closer together and tighten the support arm 15 around the sealing grommet 50. Once tightened, the sealing grommet 50 and support arm 15 should be engaged such that the fastener 30 will need to be loosened (i.e. by twisting the handle projections 31, 32 in the opposite direction) to remove the sealing grommet 50 from the support arm 15. When tightened, the sealing grommet 50 can create a waterproof seal with the support arm 15 such that water is unable to penetrate.

Figure 8:
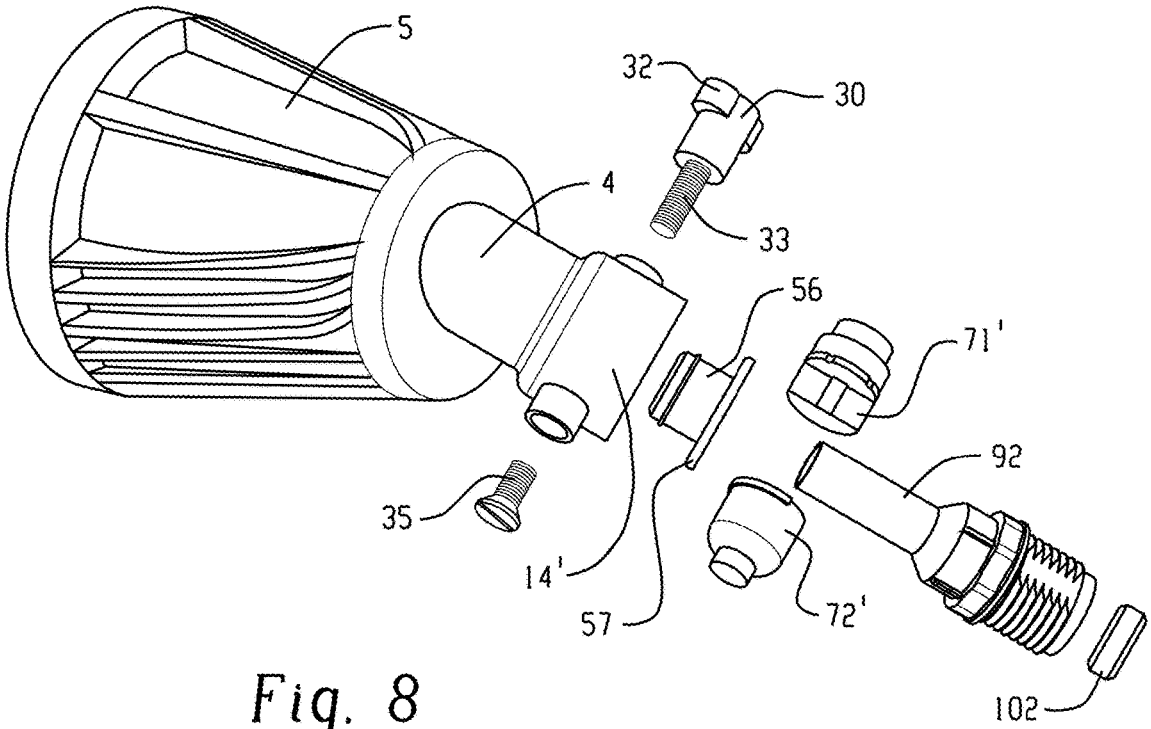
FIG. 8 is a perspective view of another embodiment of a disassembled light fixture.
Figure 9:
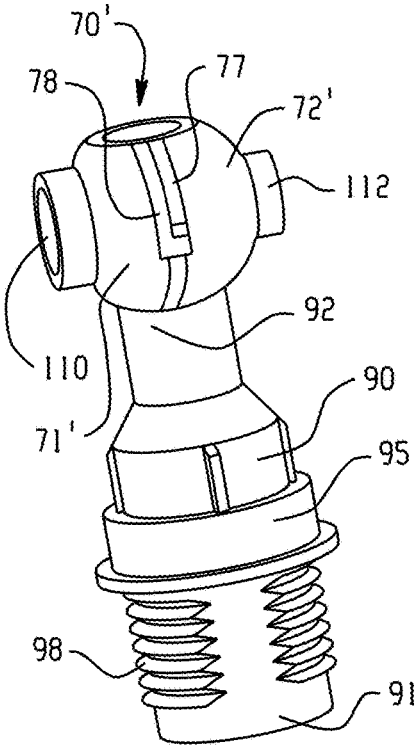
FIG. 9 is a perspective view of a spherical joint assembled onto an anchor portion.
Figure 10:
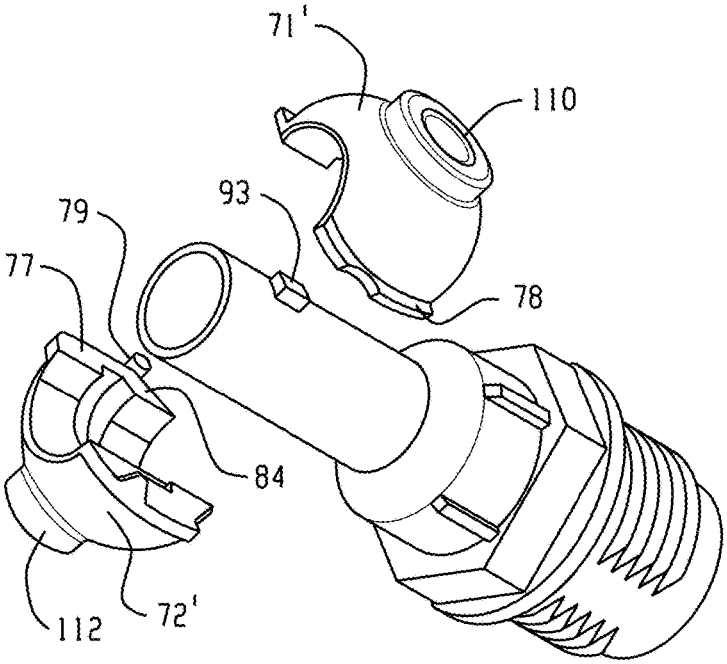
FIG. 10 depicts the spherical joint and anchor portion of FIG. 9 disassembled.

FIG. 8 is an exploded view of another embodiment of a light with a different body for connecting to a spherical joint having fastener(s) (also referred to as a lug) that engages the spherical joint through opening(s) in the side of the body. In this embodiment, the first hemisphere 71' and the second hemisphere 72' each have a protuberance 110, 112, respectively, and preferably do not include lateral groove 73. One or both of the protuberances 114, 116 can be threaded so as to engage and retain fastener(s) 30, 35. Preferably both protuberances 114, 116, are threaded. Similarly, both fastener(s) 30, 35 can be threaded, so that, when assembled, the fastener(s) 30, 35 are retained in the bosses 118, 120, and openings 114, 116.

When the light fixture is assembled, the spherical joint 70' is located in the body 14' such that the protuberances 110, 112 sit in the recesses 20, 21, and the fasteners 30, 35, extend through the bosses 118, 120, and into the openings 114, 116, securing the support assembly to the body 14', e.g., in contact with grommet 56. Essentially, the fasteners go through the bosses 118, 120 on body and the cavities 114, 116 of spherical joint thereby securing the spherical joint to the body.

Located within the body 14', is the grommet 56 (e.g., elastomeric, preferably rubber, grommet). The grommet 56 comprises groove(s) 58 configured to align the grommet 56 with the ridge(s) 19 in the body 14'. Disposed near a first end of the grommet 56 is a lip (e.g., a circumferential lip) 60. The lip 60 assists in forming a barrier against contaminants (e.g., moisture, dust, insets, and the like), passing from the body 14' into the neck 4. Similarly, extension 57, which also extends circumferentially from the outer surface of the grommet 56, is located at a second end of the grommet 56 where it contacts the spherical joint 70'. The spherical joint 70' contacts and can move over the grommet 56 in longitudinal motion.

Figure 12:
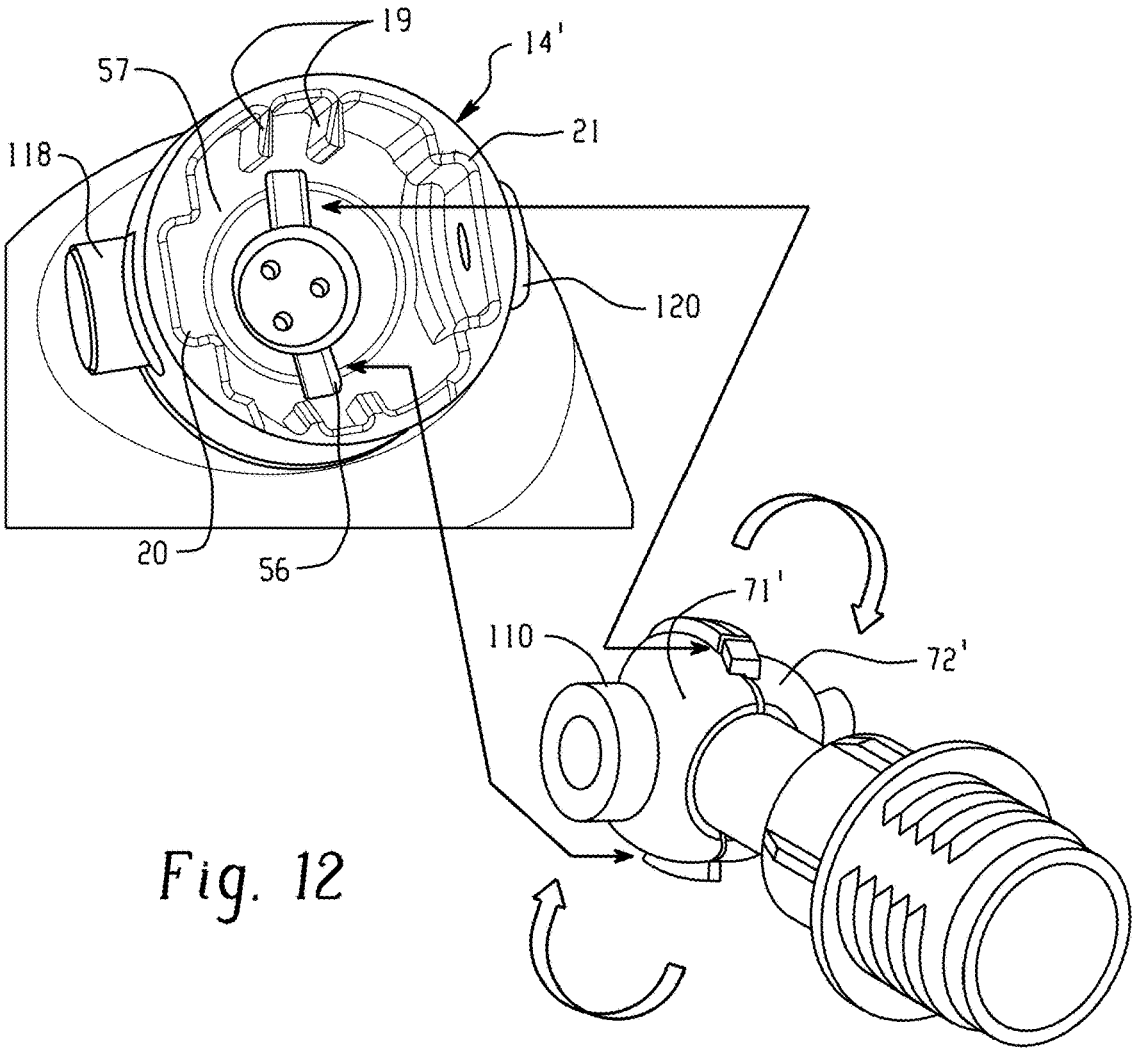
FIG. 12 depicts the engagement of a spherical joint in a sealing grommet.

The grommet 56 further comprises channels 59 figured to receive longitudinal projection(s) 77, 78, thereby allowing the light housing 5 to move longitudinally, along the central axis, as is illustrated by the arrows in FIG. 12.

Figure 11:
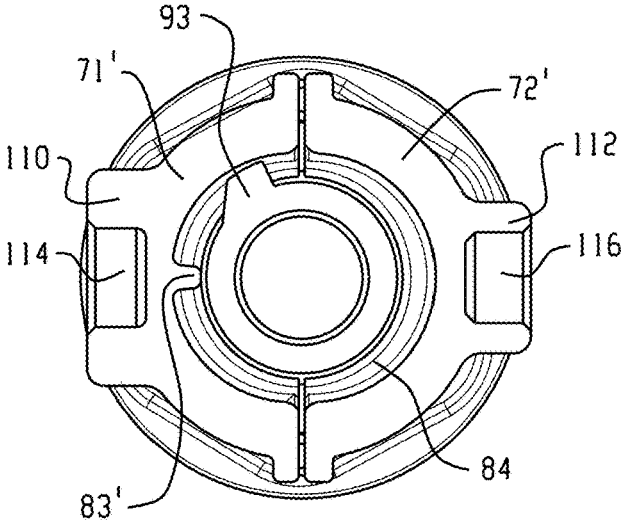
FIG. 11 is an exploded cross-sectional view of the spherical joint and anchor portion of FIG. 9.
Figure 13:
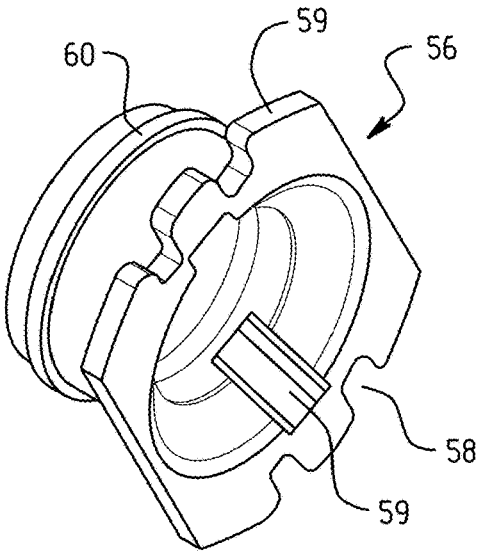
FIG. 13 is a perspective view of an embodiment of a sealing grommet.

As is illustrated in FIG. 11, when the spherical joint is assembled, it is assembled around the proximal end of the anchor portion 90 such that a tooth 93 of the anchor portion 90 is located in a channel 84 of the spherical joint 70'. The tooth 93 can be free to rotate within inner channel 84, allowing the spherical joint 70' to rotate about the central axis relative to the anchor portion 90. The inner channel 84 can extend around the inner surface 82 of the spherical joint 70 to the extent that the spherical joint 70 is desired to be free to rotate about the central axis 100 relative to the anchor portion 90. For example, the inner channel 84 can extend less than 380 (preferably less than 370, and more preferably less than 360) degrees, around the inner surface 82 of the spherical joint. Prevention of greater rotation can be attained with stopper 83' that extends into channel 84. The stopper 83' can be an inward projection that blocks the channel 84 so as to prevent movement of the tooth 93 past the stopper 83'.

A motion sensor can optionally be included on the light fixture 1 such that the motion sensor will not inhibit motion of the light housing 5.

The light fixtures disclosed herein include at least the following aspects.

Aspect 1: a light fixture including a housing having a base, a support arm, and an opening opposite the base with a lens disposed in the opening, and a light source disposed within the housing, and an anchor portion having a fastening end and a cylindrical projection with a tooth on a surface of the cylindrical projection, and a central axis extending through the anchor portion into the support arm, a spherical joint comprising an inner channel extending less than 370 degrees around the inner surface of the spherical joint, e.g., to enable rotational motion between the spherical joint and the anchor portion; and a sealing grommet located in the support arm; wherein the light fixture is configured to enable relative longitudinal motion between the spherical joint and the support arm and configured to prevent rotational motion therebetween. Optionally, wherein the spherical joint is located within a distal end of the sealing grommet and engaged with the sealing grommet to enable relative longitudinal motion therebetween and to prevent rotational motion therebetween, wherein the support arm has a neck that extends from the base to a body. Optionally, wherein the sealing grommet is located within the support arm extending into the neck of the support arm and toward the body of the support arm.

Aspect 2: The light fixture of Aspect 1, wherein the spherical joint comprises a longitudinal projection on an outer surface of the spherical joint extending along the central axis.

Aspect 3: The light fixture of any of the preceding aspects, wherein the body is adjustable such that the diameter can be lessened.

Aspect 4: The light fixture any of the preceding aspects, wherein the body comprises tabs that form an adjustable opening, wherein the tabs each comprise a bore with a fastener disposed through the bores.

Aspect 5: The light fixture of Aspect 4, wherein the fastener is threaded.

Aspect 6: The light fixture of any of Aspect 4 or 5, wherein the fastener is tightened using a nut on either side of the tabs.

Aspect 7: The light fixture of any of the preceding aspects, wherein the light fixture is waterproof.

Aspect 8: The light fixture of any of the preceding aspects, wherein the light source is a motion sensor light.

Aspect 9: The light fixture of any of the preceding aspects, wherein the spherical joint comprises two separate hemispheres.

Aspect 10: The light fixture of Aspect 9, wherein the two hemispheres have one or more gaskets disposed therebetween.

Aspect 11: The light fixture of any of Aspects 9 or 10, wherein the two hemispheres are connected with a spring clip.

Aspect 12: The light fixture of any of the preceding aspects, wherein the central bore in the support arm, the sealing grommet, the spherical joint and the anchor portion can be in alignment such that a wire or cable can pass therethrough.

Aspect 13: The light fixture of any of the preceding aspects, wherein the sealing grommet is made of rubber.

Aspect 14: The light fixture of any of the preceding aspects, wherein the diameter of a proximal end of the sealing grommet is different from the diameter of the distal end of the sealing grommet; preferably the distal end has a larger diameter than the proximal end.

Aspect 15: The light fixture of any of the preceding aspects, wherein the anchor portion further comprises a bolt for fastening the anchor portion to a support base.

Aspect 16: The light fixture of any of the preceding aspects, wherein the sealing grommet does not extend beyond the distal end of the body.

Aspect 17: The light fixture of any of the preceding aspects, wherein the spherical joint is located within a distal end of the sealing grommet.

Aspect 18: The light fixture of any of the preceding aspects, wherein the spherical joint comprises a protuberance extending away from the central axis, wherein the protuberance is located in boss in the body such that a fastener can extend through the boss and into the protuberance.

Aspect 19: The light fixture of any of the preceding aspects, wherein the spherical joint comprises a longitudinal projection configured to engage the sealing grommet to enable relative longitudinal motion therebetween and to prevent rotational motion therebetween.

While the embodiments described herein utilized a light housing and/or a light fixture, the device is not limited to this single application, it is also applicable many other applications that require pivoting and rotation with a cord passing therethrough such as speaker housings and the like.

Also, for simplicity, reference has been made to a "cord", which is not intended to limit the scope of the invention. As is understood, the invention can equally be used with, for example, a cable or a wire.

Reference has been made to "longitudinal," "longitudinal axis," and "longitudinal motion," which is meant to be interpreted according to the dictionary definition "running lengthwise rather than across," with respect to a central axis. "Longitudinal motion" should be interpreted as perpendicular to "rotational."

All ranges disclosed herein are inclusive of the endpoints, and the endpoints are independently combinable with each other (e.g., ranges of "up to 25, or, more specifically, 5 to 20", is inclusive of the endpoints and all intermediate values of the ranges of "5 to 25" etc.). Furthermore, the terms "first," "second," and the like, herein do not denote any order, quantity, or importance, but rather are used to distinguish one element from another. The terms "a" and "an" and "the" herein do not denote a limitation of quantity, and are to be construed to cover both the singular and the plural, unless otherwise indicated herein or clearly contradicted by context. The suffix "(s)" as used herein is intended to include both the singular and the plural of the term that it modifies, thereby including one or more of that term (e.g., the film(s) includes one or more films). Reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be present in other embodiments. In addition, it is to be understood that the described elements may be combined in any suitable manner in the various embodiments. All cited patents, patent applications, and other references are incorporated herein by reference in their entirety. However, if a term in the present application contradicts or conflicts with a term in the incorporated reference, the term from the present application takes precedence over the conflicting term from the incorporated reference.

What is claimed is:

1. A light fixture comprising:

a housing having a base, a support arm and an opening opposite the base with a lens disposed in the opening; and a light source disposed within the housing; and an anchor portion having a fastening end and a cylindrical projection with a tooth on a surface of the cylindrical projection, and a central axis extending through the anchor portion into the support arm;

a spherical joint comprising an inner channel extending less than 370 degrees around the inner surface of the spherical joint to enable rotational motion between the spherical joint and the anchor portion; and a sealing grommet located in the support arm;

wherein the light fixture is configured to enable relative longitudinal motion between the spherical joint and the support arm and configured to prevent rotational motion therebetween.

2. The light fixture of claim 1, wherein the spherical joint comprises a longitudinal projection on an outer surface of the spherical joint extending along the central axis.

3. The light fixture of claim 1, wherein the body is adjustable such that the diameter can be lessened.

4. The light fixture of claim 1, wherein the body comprises tabs that form an adjustable opening, wherein the tabs each comprise a bore with a fastener disposed through the bores.

5. The light fixture of claim 4, wherein the fastener is threaded.

6. The light fixture of claim 4, wherein the fastener is tightened using a nut on either side of the tabs.

7. The light fixture of claim 1, wherein the light fixture is waterproof.

8. The light fixture of claim 1, wherein the light source is a motion sensor light.

9. The light fixture of claim 1, wherein the spherical joint comprises two separate hemispheres.

10. The light fixture of claim 9, wherein the two hemispheres have one or more gaskets disposed therebetween.

11. The light fixture of claim 9, wherein the two hemispheres are connected with a spring clip.

12. The light fixture of claim 1, wherein the central bore in the support arm, the sealing grommet, the spherical joint and the anchor portion can be in alignment such that a wire or cable can pass therethrough.

13. The light fixture of claim 1, wherein the sealing grommet is made of rubber.

14. The light fixture of claim 1, wherein the diameter of a proximal end of the sealing grommet is different from the diameter of the distal end of the sealing grommet.

15. The light fixture of claim 1, wherein the anchor portion further comprises a bolt for fastening the anchor portion to a support base.

16. The light fixture of claim 1, wherein the sealing grommet does not extend beyond the distal end of the body.

17. The light fixture of claim 1, wherein the spherical joint is located within a distal end of the sealing grommet.

18. The light fixture of claim 1, wherein the spherical joint comprises a protuberance extending away from the central axis, wherein the protuberance is located in boss in the body such that a fastener can extend through the boss and into the protuberance.

19. The light fixture of claim 1, wherein the spherical joint comprises a longitudinal projection configured to engage the sealing grommet to enable relative longitudinal motion therebetween and to prevent rotational motion therebetween.

* * * * *